United States Patent [19]

Godlewski

[11] Patent Number: 4,591,144

[45] Date of Patent: May 27, 1986

[54] FEEDER FOR PRESS

[76] Inventor: Edward S. Godlewski, 129 S. Spruce St., Wooddale, Ill. 60691

[21] Appl. No.: 695,568

[22] Filed: Jan. 28, 1985

[51] Int. Cl.[4] ..... B65H 9/06

[52] U.S. Cl. ..... 271/246; 271/116

[58] Field of Search ..... 271/245, 246, 247, 229, 271/230, 116

[56] References Cited

U.S. PATENT DOCUMENTS

| | | | |
|---|---|---|---|
| 2,208,044 | 7/1940 | Ormond et al. | 271/246 X |
| 3,637,203 | 1/1972 | French | 271/246 |
| 3,888,478 | 6/1975 | Alderman, Jr. et al. | 271/245 X |
| 4,470,349 | 9/1984 | Godlewski | 271/246 X |

OTHER PUBLICATIONS

Kobus, G. S. "Integral Registration and Sheet Feeder Actuation", Xerox Disclosure Journal, vol. 7, No. 2, Mar./Apr. 1982, p. 75.

*Primary Examiner*—Bruce H. Stoner, Jr.
*Assistant Examiner*—Lawrence J. Goffney, Jr.
*Attorney, Agent, or Firm*—John J. Kowalik

[57] ABSTRACT

A slidably supporting feeding apparatus having fingers movable to stop and to release the stock for regulating delivery of the stock to a press, the fingers being driven by inertia to a complete release position in timed relation with a press feed mechanism, which during the interval of complete release of the stock by the fingers, grasps and moves the stock into the press.

20 Claims, 10 Drawing Figures

84
85
86
87
59

22
93
108
112
106
110
100
56
88
82
16
68
122
24
49
120
8
25
26
50
14
92
59
2
110'
99

FEEDER FOR PRESS

BACKGROUND OF THE INVENTION

Article feeding devices for presses have been heretofore provided of varying complexity for registering the position of an article with an imprinting device of the press to accurately position the printing on the article. These devices include vacuum feeds with their vacuum pumps and hoses etc. or precisely geared or chain driven mechanisms which grasp the article and move it in time relation with the plate cylinder of the press so that the article is fed precisely between the plate cylinder and the opposing impression cylinder. Difficulty is experienced in attempting to correlate the function of the various mechanisms with the texture of the article being fed and its thickness, surface condition and other characteristics.

DISCUSSION OF THE PRIOR ART

In the prior art in the devices under consideration, stop fingers are generally used to hold the article at its leading edge, the article being such as a sheet of paper or an envelope, and the fingers are withdrawn at a prearranged time to allow the article to advance into the printing press. The article is normally fed to pairs of friction feed rollers after being released by the fingers. Difficulty is experienced to maintain the proper synchronization between the release of the fingers and the advance of the article into the press and in many instances laborious adjustments are required because the mechanism will not admit to wide tolerances and therefore minute incremental tuning is necessary.

SUMMARY OF THE INVENTION

This invention relates to a feed mechanism of novel concept which utilizes the momentum of the parts to withdraw the stop fingers in the last increment of their movement from hold to release position.

The invention contemplates making the fingers and their mounting as well as their depressor mechanism to swing about a horizontal axis such that when the motivating mechanism operating the depressor is at the end of its stroke, the fingers and depressor mechanism will, due to inertia, continue to move in a fingerdepressing direction to complete withdrawal of the fingers from the leading edge of an article being stopped by the fingers, the entire dissappearance of the fingers occuring substantially at the instant that a pair of feed rollers are caused to grasp the article while power is being applied to the feed rollers to drive them and propel the article over the disappeared fingers and thus into the press. This feature provides the lag time for the article to advance over the fingers without interference into the grasping and conveying mechanism of the press, and eliminates the necessity of providing hold down mechanisms for holding the article against bridging over the stop fingers while it is being forced against the fingers prior to the fingers being completely moved to unobstructing position. The movement of the fingers at their last increment is tantamount to a lost motion in that the motivating mechanism separates from the finger depressors and the depressors as well as the fingers move due to the forces of inertia. The instant mechanism entirely eliminates the precise mechanisms which must constantly positively hold the article during its entire travel on the conveyor and at the same time prevent the article from prematurely jumping over the fingers and feed into the press.

A general object of this invention is to provide an improved simplified and effective mechanism for orienting imprintable stock and feeding the same in registering sequence to a press.

These and other objects and advantages inherent in and encompassed by the invention will become more apparent from the the specification and the drawings, wherein.

DESCRIPTION OF THE INVENTION

Figures 1, 9:
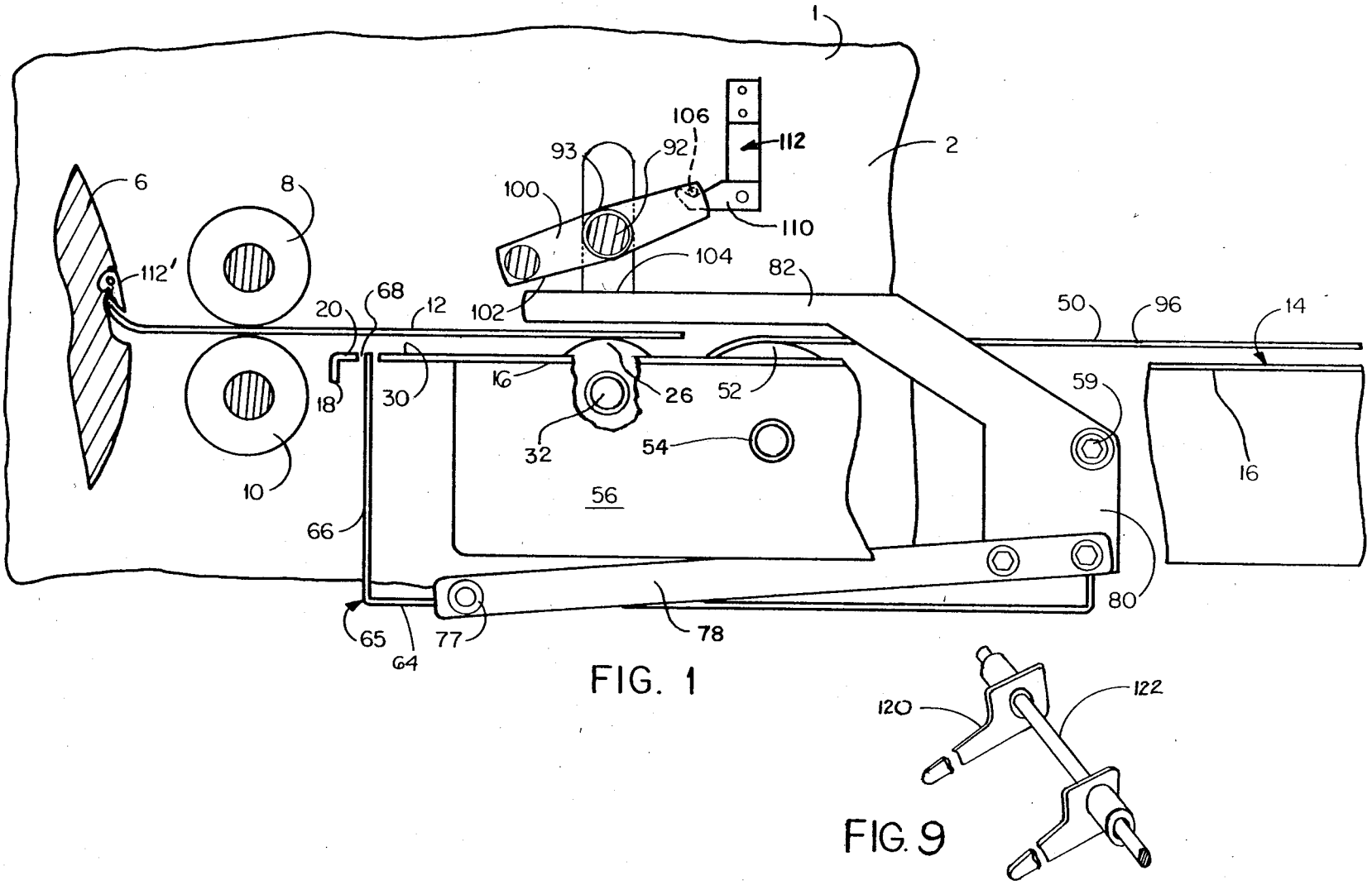
FIG. 1 is a fragmentary side elevational view partly in section showing the mechanism in feeding position.
FIG. 9 is a perspective view of the stock guide assembly.

This invention is shown with a typical press 1, fragmentarily illustrated, and which includes a side frame or wall 2 at each side between which are mounted various cylinders(not shown) including an impression cylinder 6 fragmentarily shown, rotatable on a horizontal axis and in front of which are mounted a pair of cooperative feed rollers 8 and 10 which are positioned in receiving relation to stock items, such as sheets of paper 12 or envelopes etc., being delivered thereto by a conveyor generally designated 14.

The conveyor 14 is adapted for removable attachment to the press and comprises a bottom or horizontal base wall or plate 16 which has a downwardly turned flange 18 at its forward or delivery end 20. Flange 18 is adapted to extend into a slot 21 in a horizontal guide plate 22 which is affixed to the side frames or walls 2 of the press and positioned in front of, that is, the receiving side of the feed rollers 8 and 10.

The plate 16 is apertured at 24 centrally thereof and the bottom section of a metering feed roller assembly 25 is mounted on the plate 16 and comprises a free rolling feed wheel or roller 26 protruding through the aperture 24 above the top stock-support surface 30 of the bottom plate 16 of the forward portion of the conveyor 14. The wheel 26, which is made of suitable plastic material such as soft polypropylene or other elastomeric material such as neoprene and the like, is rotatably mounted on the center shaft 32 which at its ends is positioned in upwardly open slots 34,34 in vertical side flanges 36,36 of brackets 38,38. The shaft 32 is biased upwardly to the top of its respective slot 34 by one end of a torsion spring 42 which has its other end formed as a coil 44 wrapped about a cylindrical mounting block 45 attached to the side flange of the respective bracket 38 . The other end of the coil is anchored to the associated block 45. Each bracket has a horizontal flange 48 which is attached by bolt and nut assemblies 49 to the underside of the conveyor plate 16.

The lower feed wheel 26 is positioned in alignment longitudinally of the conveyor in the direction of feed of the stock with a feed belt 50 trained about a pulley 52 rotatably supported on a horizontal shaft 54 which is carried at opposite ends from the walls 56,56 of the conveyor 14, said side walls 56,56 being connected at their upper ends to the lateral edges of of the plate 16 which may be transversely split at 58 to facilitate manufacture and assembly.

A shaft 59, supported between the side walls 56, 56 provides a pivotal mount about a horizontal axis for the rear bearings 60,60 formed on the rear ends 62,62 of operating arms 64,64 of a pair of finger assemblies 65,65 which flank the pulley 52. The arms extend to adjacent the forward end of the conveyor 14 and are connected at their forward ends to the lower ends bf upright fingers 66,66 which project through slots or apertures 68,68 formed in the forward end portion of plate 16.

Figure 5:
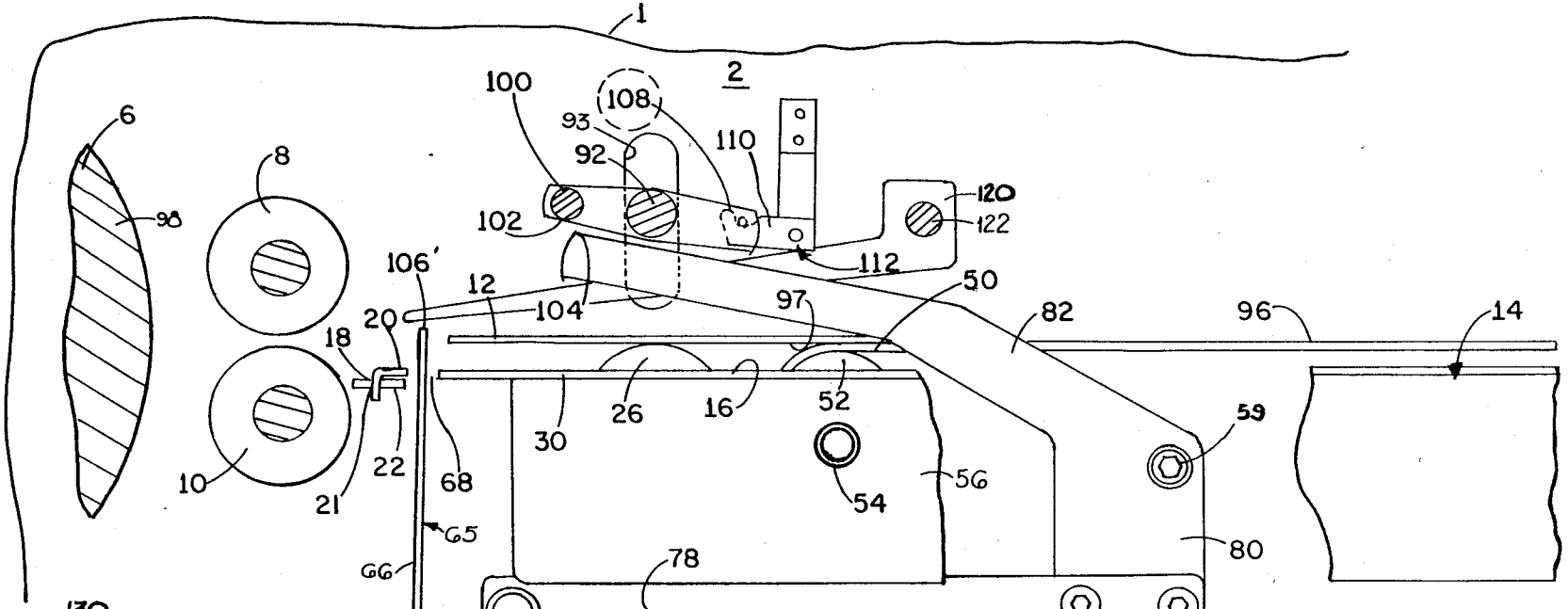
FIG. 5 is a fragmentary side elevational view partly in cross-section showing the parts in a non-feeding position and with the upper feed wheel removed.

The fingers 66 in raised position as shown in FIG. 5 project upwardly through the respective apertures 68 in intercepting position to articles issuing from the conveyor as best seen in FIG. 5.

The finger assemblies are each individually biased upwardly by a torsion spring 70 which has its coil 71 wound about a mounting sleeve 72 fastened to the stationary shaft 59 and having one end anchored to sleeve 72 and the other end 74 anchored to the respective end of 64 at 75 in lifting relation thereto.

A U-shaped depressor assembly 76 is provided for lowering the fingers in timed relation to the press operation and comprises a cross-bar 77 at its front end disposed between and connected to the forward ends of a pair of lower legs 78,78, the rear ends of which are each connected to the lower end of a respective bight portion 80. The upper end of each bight portion is connected to the rear end of a forwardly extending leg 82. Each bight portion 80 is pivoted on shaft 59 and with its upper and lower legs is biased upwardly by a torsion spring 84 having its coil 85 wrapped about a mounting collar 86 sleeved on and secured to the stationary shaft 59. The spring coil has one end portion anchored as at 87 to the respective collar 86 and the other end anchored to a clip 88 on the adjacent bight 80 and biases the depressor assembly in a direction raising the legs 82 upwardly as well as the bar 77 which overlies and contacts the arms 64,64 of the finger assemblies.

A drive wheel 90 (FIG. 8) is positioned above and in vertical alignment with the lower feed wheel 26 and is mounted through a one way clutch 91 to a horizontal drive shaft 92 which at opposite ends is provided with journal bearings mounted in vertically elongated slots 93 formed in the side walls 2,2 of the printer. The shaft 92 and the wheel 90 are adapted to move vertically, shaft 92 being movable in the slots 93 to engage the wheel 90 with the wheel 26 and upwardly to disengaged position.

In the disengaged position of the wheels or rollers 90, 26 each stock item is moved in timed sequence by the belt 50 over the pullout wheel 26 and the stock is brought with its leading edge against the upraised fingers. If the stock arrives sooner than required, the top 96 of the belt abrades against the bottom 97 of the paper sheet and slides under the paper while constantly urging the sheet against the extended fingers. The belt is made of materials providing a sufficient coefficient of friction as is described in my U.S. Pat. No. 4,470,349. At this time as seen in FIG. 5 the impression roller has its smooth cylindrical sector 98 facing the conveyor.

Figures 2, 6, 7:
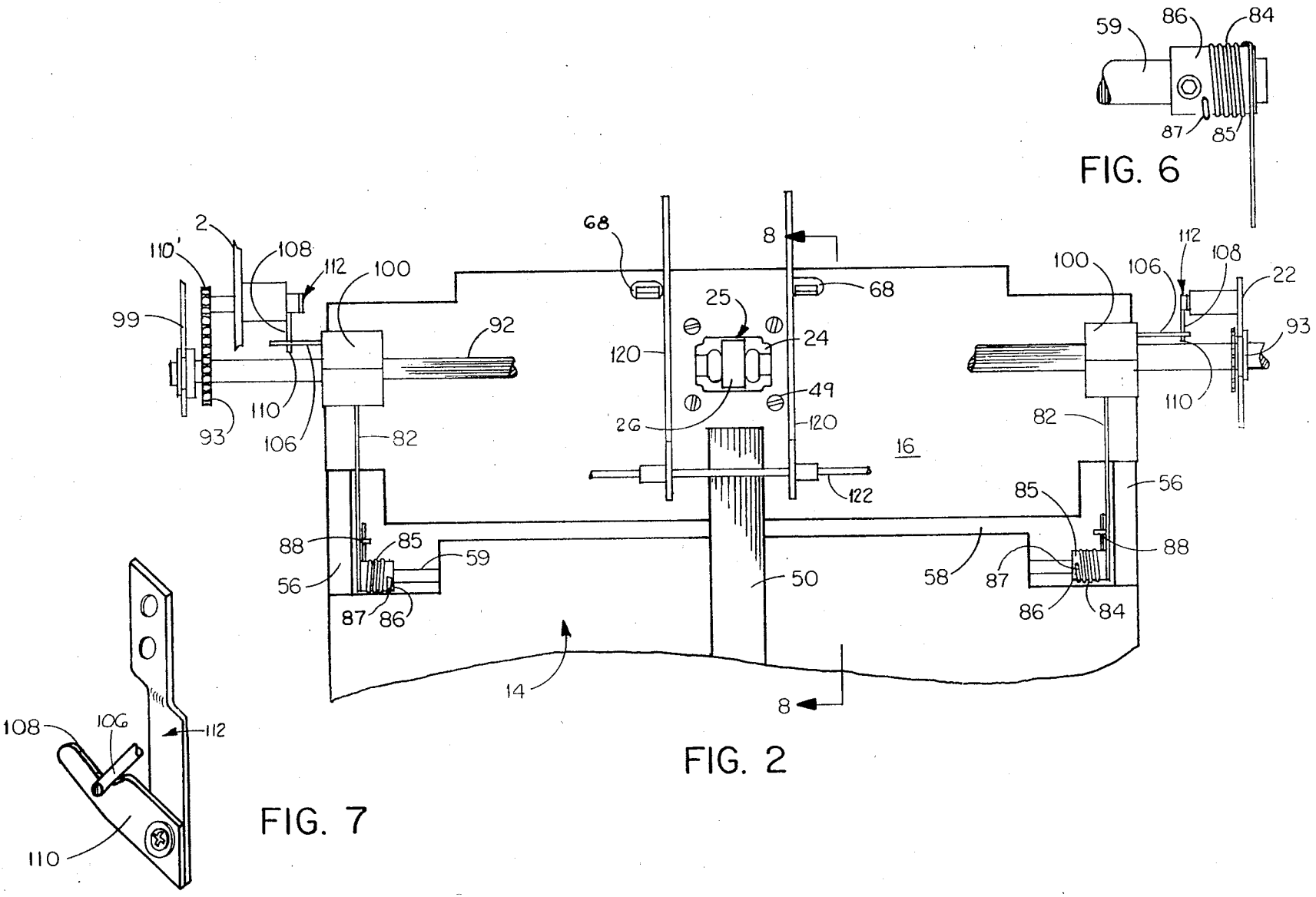
FIG. 2 is a fragmentary top plan view partly broken away.
FIG. 6 is an enlarged view of one of the lift spring arrangements for the finger depresser assembly.
FIG. 7 is a perspective view of the cam pin slide.
Figure 3:
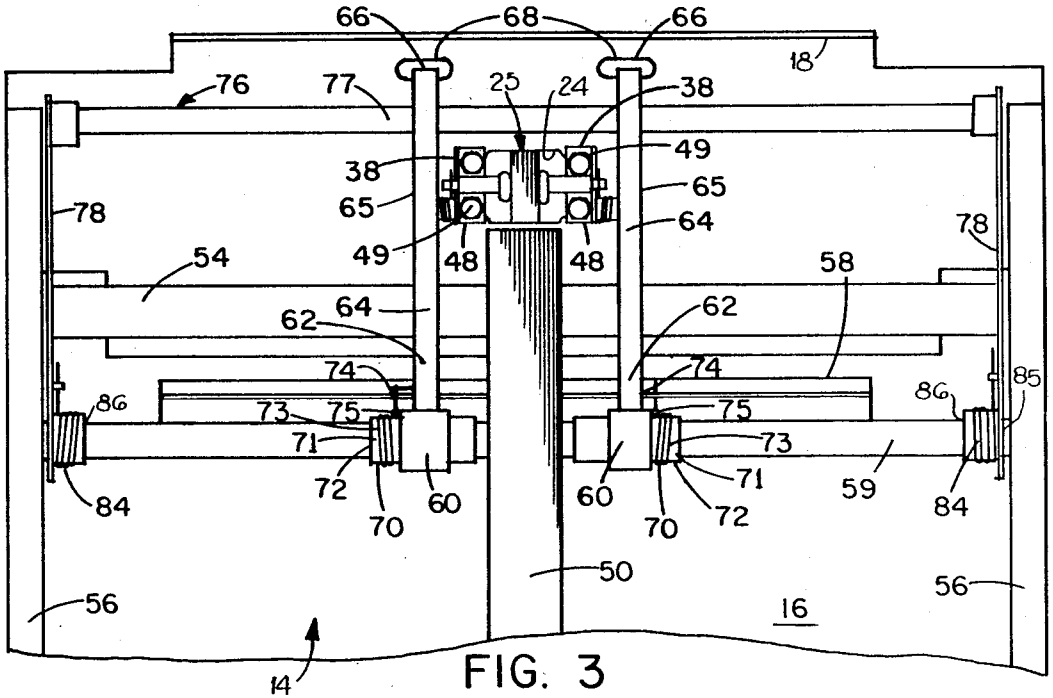
FIG. 3 is a fragmentary bottom plan view.
Figure 8:
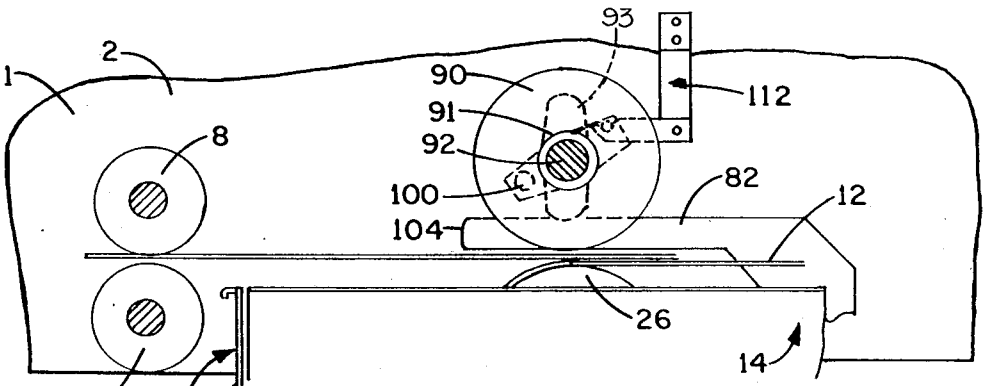
FIG. 8 is a cross-section on line 8—8 of FIG. 2 including the upper feed roller.
Figure 4:
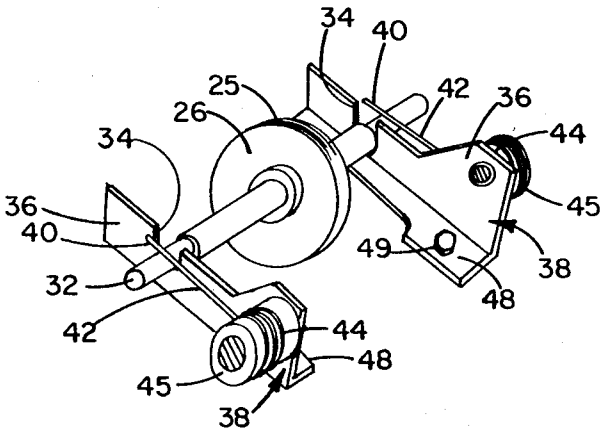
FIG. 4 is an enlarged bottom perspective of a lower feed roller assembly.

In order to drive the sheet into the grasping feed rollers of the press, the shaft 92 is forced downwardly at each end by a trip lever 99 (fragmentarily shown in FIG. 2), which is part of the press mechanism, such that the top pullout drive wheel 90 grasps the stock item with the bottom wheel 26 as seen in FIG. 8.

The shaft 92 pivotally supports adjacent to each end a cam member 100 which has a bottom camming surface 102 overlying and opposing the upper edge 104 of the adjacent top leg of the depressor. The cam is caused to rotate in a camming direction by a pin 106 which protrudes from one side of the cam member and rests on top of the camming profile 108 formed on top of the projection 110 of a cam hook 112 (FIG. 7) which is fastened to the adjacent side frame of the press. Thus as the shaft is caused to move downwardly as predetermined, the cam members rotate bringing their surfaces 102 against the edges 104 and depressing the upper legs 82 and thus pivoting the lower legs downwardly and causing the depressor bar 77 to move the finger assemblies downwardly.

The upper wheel 90 obtains a positive purchase or grasp on the stock item therebelow with the yieldable free rolling lower wheel 26 attendant to depressing the same and before rotating simultaneously the cams stop pivoting since shaft 92 has reached the lowermost position or end of its stroke at this time, the upper ends of the fingers barely protrude above the plate 16 and continue to hold the stock items from advancing beyond the fingers. Thereafter the inertia of the depressor and of the finger assembly causes the upper legs 82 to depart or disengage from the cams and the depressor continues to swing with the fingers in a direction causing the lower legs of the depressor to move downwardly with the depressor bar connected thereto thus causing the fingers 66 to withdraw their uppermost ends 106' below the plate 16 thereby releasing the paper stock. At this moment the power train 110' which is shown as a sprocket and chain drive at each end of the shaft 92 is driven thereby rotating the shaft 92 and wheel 90 which advances the stock over the retracted fingers and into the feed rollers 8 and 10 of the press which at this time close and grasp the paper stock and then advance the paper stock onto the grippers 112' on the rotating impression cylinder (see FIG. 1) which is timed to position the grippers as shown. As the grippers clamp onto the leading edge of the paper stock, the rollers 90 and 26 and the rollers 8 and 10 begin to separate and the impression cylinder rotates as shown by the arrow. The stock is then wrapped about cylinder 6 and presented to the other printing components of the press such as the plate cylinder or offset blanket (not show) as is well known to those skilled in the art. Any lag in the release of the paper by wheels 90,26 is accommodated by the overrunning clutch 91 and the free rolling of the wheel 26.

After feeding each piece of stock individually, the shaft 52 is moved upwardly and the depressor likewise swings in a direction to cause its upper and lower legs to swing upwardly allowing the fingers to be spring biased to lift to stop position. The next sequentially fed stock item is then advanced between the rollers 90,26 and the leading edge of the stock is brought into contact with the raised fingers by the conveyor and the previously described cycle is repeated.

In order to prevent the paper 12 from flying over the top ends of the fingers when they are in raised position as seen in FIG. 5, there are provided a pair of holddown guides 120,120 which are carried at their rear upper end on a transverse rod 122 which is mounted on and supported between the side panels 2,2 of the press.

Figure 10:
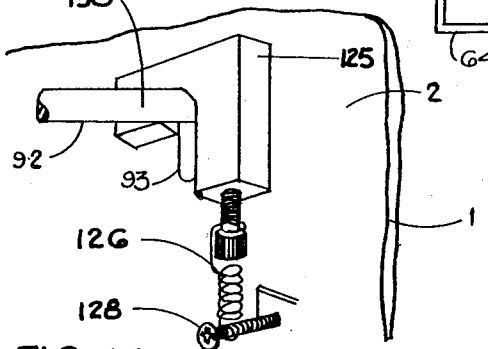
FIG. 10 is a fragmentary perspective view of the antihammering mechanism.

In FIG. 10 there is shown a spring-biased anti-hammering control assembly 125 for controling and holding under yieldable spring load the upward and downward movement of the shaft 92 which is pulled in its downward movement by a tension spring 126 connected at its lower end to a bolt type of anchor 128 threadedly mounted on the adjacent side wall 2 of the press and at its upper end is connected to one leg of a hook 130 which is hooked over the shaft 92. There is one such assembly 125 at each end of the shaft 92 and they serve not only to take up the back lash between the operating forks 99 and the associated bearings on shaft 92, but also serve as a positive means for pulling the shaft 92 downwardly.

The fingers 65 also designate gate means or stop means which swing vertically and are only lightly biased upwardly as also is the depressor, both of which constitute the driven component or section, whereas the shaft 92 and cam 100 constitute the driving component or section and is part of the actuating means with the cam.

The raised position of the fingers is also designated the intercept position. FIG. 8 shows the complete release position of the fingers and the partial release intermediate position at the time when the cam is at the end of its stroke and the leg 92 engages the cam profile 102.

I claim:

1. A feeding apparatus for a printing press comprising an infeed cylinder having means for gripping an imprintable stock item and drawing it into the press for imprinting thereby, conveying means disposed in stock item delivery relation to said cylinder and comprising an impositive feed component for carrying said stock item toward the press, stop means disposed between said conveying means and the press and having an intercepting position for blocking the stock from delivery to the press and having a release position disposed out of the path of movement of the stock items for delivery thereof by the conveying means to the press, actuating means for moving said stop means between said intercepting position and said release position, said actuating means comprising a driving section and a driven section, said driven section being pushed a predetermined distance by said driving section to an intermediate position and thereafter disengaging therefrom and having sufficient inertia to move said stop means to a complete release position accommodating movement of the stock items to the press, and means for positively grasping and moving the stock items delivered thereto by said impositive feeding component to said cylinder during an interval between complete release of said stop means and subsequent repositioning of said stop means in stop position.

2. The invention according to claim 1 and said grasping means comprising interval-driven feed roller means disposed between said stop means and said infeed cylinder.

3. The invention according to claim 2 and said actuating means including a transversely movable drive shaft, and said feed roller means having a roller mounted on the shaft, and anti-hammering means associated with the shaft for controlling said movements thereof.

4. The invention according to claim 3 and said anti-hammering means comprising a spring-actuated element hooked about the shaft and operative to impose biasing loads on the shaft parallel with said movements thereof.

5. The invention according to claim 2 and said actuating means comprising a vertically reciprocal shaft and said roller means comprising a top roller mounted via a one-way clutch on said shaft and an opposing roller mounted below the top roller for grasping engagement of stock items passed therebetween consequent to downward movement of said shaft in predetermined timed relation coincident with release of a stock item and feeding of the same into the feed roller means.

6. The invention according to claim 5 and said driving section comprising cam means pivotally mounted on said shaft, and means for pivoting said cam means attendant to movement of the shaft in a direction for engaging said rollers whereupon said cam means drivingly engages said driven section and the latter is caused to move said stop means to release position.

7. A press having means for imprinting stock items presented thereto, a feeding mechanism comprising a conveyor including a conveying element having a slidable surface for carrying and advancing said stock items in a predetermined sequence to the press, finger stop means movable to interposed stop position between the advancing items and said press for stopping movement of said items toward the press attendant to concurrent sliding movement of said surface under said items, said finger stop means movable to a release position for allowing said items to advance to said press from said conveyor, and means for actuating said finger means from said stop to said release positions and including a power operated actuating portion having an actuating powered stroke of predetermined extent, said actuating means having an actuated portion operative between said actuating portion and said finger means, said actuated portion having an inertia storing mass sufficient to disengage said actuated portion from said actuating portion after being pushed by said actuating portion to the extent of its stroke to move said finger means to a completely released position to permit said items to advance over said finger means into the press.

8. The invention according to claim 7 and said actuating means comprising a vertically movable shaft, cam means pivotally mounted on the shaft, means on the press having a camming surface for engagement by said cam means attendant to said shaft being moved in a downward direction for effecting pivoting movement of the cam means, and means for translating said movement of the cam means to movement of said finger stop means to releasing position.

9. The invention according to claim 8 and feed roller means interposed between said finger stop means and the press, a support on the press, said roller means comprising a pair of cooperating rollers one mounted on the shaft for movement therewith toward the other roller and the other roller being mounted on the support.

10. The invention according to claim 9 and biasing means reactive between the shaft and said support for urging said shaft in a direction engaging said rollers.

11. The invention according to claim 7 and said inertia storing mass comprising a swingably mounted depressor engageable with said finger stop means, and means yieldably biasing said finger stop means and said depressor to stop position of said finger stop means.

12. The invention according to claim 7 and said actuating means comprising a shaft movable transversely for operating said actuating means, and conveying means mounted on and driven by said shaft for grasping and delivering said items in predetermined timed relation to the press.

13. The invention according to claim 12 and control means operatively associated with the shaft for supplementing said transverse movements thereof in a direction driving said actuating means.

14. A feeding device for a printing press comprising infeed means on the press for drawing imprintable items into the press, conveying means for feeding said items to said infeed means, gate means interposed between said conveying means and said infeed means movable between stop and release positions for respectively holding said items from delivery to said infeed means and permitting delivery thereto, means for operating said gate means for movement between said stop and release positions including disengageable driving and driven components, said driving component having a stroke sufficient to move said gate means through said driven component to an intermediate partially release position and to impose an inertia moment on said driven component sufficient to cause said driven component to disengage from the driving component to move said gate means from said partially release position to a fully release position.

15. The invention according to claim 14 and said driven component including a swingably mounted depressor engageable with said gate means, and said gate means being swingably mounted and lightly biased with said depressor to position said gate means in stop position.

16. The invention according to claim 15 and said driving component comprising a vertically movable drive shaft, and and feed rollers including a driving roller mounted on the shaft and driven thereby, and a free rolling roller opposing said driving roller and positioned for grasping items passed therebetween en route to said press.

17. The invention according to claim 16 and means for initiating rotation of the shaft at the moment of said gate means being positioned in complete release position until said items are entered between said feed rollers.

18. The invention according to claim 17 and means for augmenting movement of said shaft and driving roller to itemgrasping condition.

19. The invention according to claim 18 and said augmenting means comprising spring means reactively connected to the shaft.

20. The invention according to claim 14 and guide means overlying said conveying means and disposed in flanking relation to said feed roller means and extending between laterally spaced portions of said gate means for preventing the items from flying over said gate means when in stop position.

* * * * *